US006490843B1

(12) United States Patent
May

(10) Patent No.: US 6,490,843 B1
(45) Date of Patent: Dec. 10, 2002

(54) CARTON FEEDING METHOD AND APPARATUS

(76) Inventor: Kevin May, 352 Fenbrook Way, Marietta, GA (US) 30064

( * ) Notice: Subject to any disclaimer, the term of this patent is extended or adjusted under 35 U.S.C. 154(b) by 0 days.

(21) Appl. No.: 09/536,657

(22) Filed: Mar. 28, 2000

Related U.S. Application Data

(63) Continuation-in-part of application No. 09/366,608, filed on Aug. 3, 1999.

(51) Int. Cl.[7] ..... B65B 41/00
(52) U.S. Cl. ..... 53/389.1; 53/566; 271/108
(58) Field of Search ..... 53/566, 389.1; 271/11, 90, 108, 96

(56) References Cited

U.S. PATENT DOCUMENTS 3,222,059 A * 12/1965 Southcott ..... 271/96
3,761,077 A * 9/1973 Vollrath ..... 271/108
3,973,768 A * 8/1976 Shannon ..... 271/108
4,034,658 A * 7/1977 Sherman ..... 493/177
4,145,040 A * 3/1979 Huber ..... 271/195
4,440,388 A * 4/1984 Divoux ..... 271/195
4,464,219 A * 8/1984 Colombo ..... 493/205
4,709,538 A * 12/1987 Olsen, Jr. ..... 53/579
5,062,603 A * 11/1991 Smith ..... 271/108
5,480,137 A * 1/1996 Haupenthal ..... 271/108
5,685,534 A * 11/1997 Zeltner ..... 271/108
6,213,286 B1 * 4/2001 Hunter ..... 271/11

* cited by examiner

*Primary Examiner*—John Sipos

(57) ABSTRACT

A carton feeder for a continuous motion packaging machine utilizes a speed compensation mechanism implemented through a rotating valve assembly and actuation system. The rotating valve assembly provides a vacuum and compression to vacuum cups, for facilitating the transfer and release, respectively, of cartons within the carton feeder. The valve assembly includes a base plate and a rotating port plate. A circumferential position adjustment of the base plate advances or retards timing of the vacuum/compression to the vacuum cups within the carton feeder. A pneumatic cylinder assembly adjusts the circumferential position of the base plate. A speed sensor senses machine speed and sends a machine speed signal to a controller. The controller signals a solenoid responsive to machine speed to extend or retract the pneumatic cylinder assembly, thereby circumferentially adjusting the valve base to advance or retard vacuum timing.

10 Claims, 15 Drawing Sheets

CARTON FEEDING METHOD AND APPARATUS

CONTINUING APPLICATION DATA

This Application is a Continuation-In-Part (CIP) of Application Ser. No. 09/366,608, filed on Aug. 3, 1999, and entitled "Carton Feeding Method and Apparatus."

FIELD OF THE INVENTION

This invention relates to a method and apparatus for feeding planar objects, such as cartons or panels. The invention is particularly suited for consecutively delivering paperboard cartons in a continuous motion-packaging machine to a downstream workstation of the machine.

BACKGROUND OF THE INVENTION

Continuous motion packaging machines used to package articles such as beverage containers include numerous workstations, such as those which either manipulate a carton blank, group a selected numbers of articles or place the articles into fully formed cartons. Such packaging machines are well known, and typically include a carton feeder having a magazine which delivers carton blanks to a selecting device that continuously selects cartons one at a time from the magazine and delivers the selected cartons to a packaging machine conveyor. The magazine and the selecting device, or selector, collectively comprise the carton feeder, such as rotary feeders and segmented wheel feeders. The magazine delivers the cartons to the selector either by gravity or by way of a magazine conveyor, such as a chain conveyor, or by using a combination of gravity feed and a magazine conveyor. The packaging machine conveyor transports the selected carton to the next workstation, where the carton is manipulated in preparation for holding the articles.

Known selector assemblies may include reciprocating levers which position a vacuum cup to contact the front surface of the leading carton in the magazine, and pull at least a portion of that carton from the magazine, at which point it is engaged by a wheel for delivery to a conveying assembly, such as opposed nip rollers. These known systems are used in segmented wheel feeders, such as those disclosed in U.S. Pat. No. 4,034,658 to Sherman and U.S. Pat. No. 4,709,538 to Olsen, Jr. et al. Specifically, selector including a vacuum assembly and a picking assembly having a lever arm and supporting a vacuum cup to contact the leading carton or carton blank in the magazine. The top edge of the leading carton is pulled by the picking assembly below an upper retaining clip, and moved in a downstream direction. A rotating segmented wheel, that is a split-type wheel defining one or more cut out portions to form segments, turns toward the carton selection zone and the leading carton. The segments of the rotating wheel or wheels contact the carton, and cause the carton to move between the periphery of the segmented wheel and the periphery of an adjacent nip roller. Further rotation of the segmented wheel pulls the carton fully out of the magazine and downstream of the segmented wheel and nip roller to a further conveying device, such as additional nip rollers and/or belt or chain conveyors. The carton then is moved further downstream to the next carton workstation where the carton blank may be positioned for wrapping around a preformed bottle group or, in the case of a collapsed basket-type or sleeve-type carton blank, manipulated into an opened position for receiving the articles.

Packaging machine productivity commonly is measured by the number of fully packaged cartons containing a particular article group configuration processed through the machine per minute. Additionally, many packaging machines are capable of being configured to package different article configurations, which can increase or decrease the number of article groups packaged per minute. Other advances in the various workstations of packaging machines have increased the speed and efficiency at which the cartons are manipulated, the articles are arranged into groups and placed into the carton, and in fully enclosing certain types of cartons around the articles.

Increased or decreased packaging machine speed necessitates that components be operated faster or slower to match the speed change, which can require that some operations be initiated at different cycle positions. For example, it is known that vacuum valves controlling delivery of vacuum in feeders can be advanced or retarded to cause the vacuum delivery to reach the vacuum cup at the same feeder position, regardless of the carton feeder or carton opener speed. One known adjustable valve includes a disk with an arcuate slot contacting an adjacent disk with spaced ports. The rotational position of the slotted disk with respect to the ported disk can be changed selectively to alter the timing of the vacuum and pressurized air cycles. In another packaging machine operation, that is the carton closing workstation in certain types of packaging machines, the apparatus which delivers glue to a carton flap prior to folding mating flaps together can be controlled using a programmable limit switch/encoder assembly. As the encoder detects a change in machine speed, which can be a function of the position of a selected packaging machine component, the limit switch operates to control the timing of glue delivery to "match" machine speed.

As the packaging operations of the entire process increase in speed, the carton feeder also must deliver the cartons to the downstream workstations of the packaging machine at a matching rate. Known, high speed carton feeders can deliver certain types of cartons efficiently at rates up to approximately 300 cartons per minute, with the most common beverage container packaging machine speed presently operating in the range of approximately 150–300 cartons per minute. With increased machine speeds, however, problems can arise in carton feeding. As machine speeds approach 300 cartons per minute, the efficiency of known, high speed carton feeders decreases. For example, there is an increased risk of the picking assembly's failing properly to remove a carton from the magazine, or failing to release the carton from the vacuum cups at the appropriate position. These occurrences can lead to additional problems, including machine jams and increased vacuum cup wear. Further, it is recognized that cartons which have become warped due to storage conditions but which are otherwise suitable for packaging articles are more difficult to remove from the magazine, especially at higher speeds. This difficulty also can exist particularly with respect to certain types of cartons, such as wrap-type cartons which include numerous performed design cuts and surfaces. Also cartons which have inconsistent varnish application tend to adhere to one another when loaded in the magazine, and can be difficult to select.

As known carton feeders have increased in speed, it has been found advantageous to use pressurized air to cause the carton to be efficiently released from the vacuum cups at the correct feeder position. The use of pressurized air in addition to the vacuum used to pull the carton from the magazine, especially at high machine speeds, presents additional challenges relating to delivering the vacuum to the vacuum cups at the precise moment the vacuum cups contact the carton, while also delivering pressurized air to the cups at the precise feeder position at which the cups must release the carton.

SUMMARY OF THE INVENTION

The present inventions include a method of feeding cartons or other planar objects, including but not limited to divider panels or partitions used in some beverage cartons, such as in an article packaging machine, and the apparatus for carrying out this method. The preferred embodiment of this apparatus includes a segmented wheel-type carton feeder capable of efficiently delivering carton blanks at rates of up to approximately 400–600 cartons per minute, under optimum conditions. The upper end of this range, however, presently is in excess of the efficient packaging capabilities of most known continuous motion, beverage container packaging machines. A first embodiment of the present invention includes an electronically actuated, solenoid dual valve assembly in which a valve for delivering pressurized air is coupled to a vacuum valve. This valve assembly itself is coupled to a distribution manifold which is placed in relatively close proximity to the vacuum cups. This arrangement optimizes valve efficiency by more accurately controlling the time required to deliver both the vacuum and the pressurized air to the cups at selected times or feeder positions. The inventions also can include a speed compensating assembly for the carton selector which advances or retards the valve assembly's actuation in relation to the carton feeder speed. This speed compensating assembly can include an encoder driven from or reading the speed or position of one of the feeder shafts. The encoder is operatively connected to a programmable limit switch. The programmable limit switch (PLS) controls the operation of the valve assembly by signaling a valve controller based upon information manually programmed into the PLS and also upon data input into the PLS by the encoder. This speed compensation control can be necessary when operating the feeder at higher speeds, considering the rate at which the valves must be cycled, the time required for vacuum or air to reach the cups and the associated small margin of error acceptable in operating the valves at high feeder speeds.

In an alternative embodiment of the present invention, the packaging machine may utilize a specialized mechanical valve assembly for selectively applying a vacuum and compressed air (compression) to the vacuum cups. More specifically, the mechanical valve assembly is driven by the packaging machine and replaces the electronic solenoid-actuated dual valve. The valve assembly is formed from a relatively stationary, circumferentially adjustable valve base and a rotating port plate, each having surfaces which engage one another. The circumferentially adjustable valve base and rotating port plate work together to selectively provide a vacuum to the vacuum cup during the selection and transfer of a carton, and for providing compression to the vacuum cup to facilitate release of the carton. A circumferential adjustment of the valve base may advance or retard the successive application of a vacuum and compression applied to the vacuum cup.

In this alternative embodiment, the packaging machine includes an actuator for providing a radial adjustment to the vacuum valve base to advance or retard the vacuum and compression application timing in response to the machine speed. More specifically, the valve assembly includes a radial adjustment arm extending radially outward from the valve base. The actuator includes an air cylinder actuator assembly coupled between the packaging machine and the radial adjustment arm, wherein the cylinder linearly extends to rotate the radial adjustment arm on the valve base to adjust valve timing. In this embodiment, the controller may include an encoder that produces signal indicative of machine speed. A logic control unit receives the speed signal, determines the correct valve position for a given speed, and actuates a solenoid-actuated valve to extend or contract the air cylinder actuator assembly, which rotates the valve base plate, thereby advancing or retarding timing of vacuum and compression application to the vacuum cups.

The air cylinder actuator assembly may include first and second pneumatic cylinders connected in a tandem arrangement, wherein each cylinder has a retracted and an extended position. In this manner, when the cylinders are connected to form the assembly, the assembly may include a retracted position that includes the first and second cylinders in a retracted position, a first extended position with the first cylinder in an extended position and the second cylinder in a retracted position, and a second extended position wherein the first and second cylinders are both in an extended position. In this manner, the air cylinder assembly may adjust the valve assembly into one of three positions to advance or retard the timing of vacuum and compression application to the vacuum cup responsive to machine speed. Each valve position may correspond to a specific machine speed range or threshold speed.

The adjustable valve assembly includes an adjustable valve base plate that has a peripheral wall, an inner bearing surface, a vacuum supply inlet extending from the base plate peripheral surface and terminating at a first distance from the center portion of the valve assembly, a vacuum inlet port extending from the terminal end of the vacuum supply inlet and terminating at the base plate bearing surface, and a vacuum/compression outlet extending from the peripheral wall and terminating at a second distance from a center portion of the valve assembly. The adjustable valve base plate also includes a vacuum outlet port extending between the compression/vacuum outlet port and the base plate bearing surface at the first distance from the center portion of the valve assembly, and a compressed air outlet port extending from the compression/vacuum outlet port to the base plate bearing surface at the second distance from the valve assembly center portion. Finally, the adjustable valve base plate includes a compressed air inlet extending from the base plate peripheral surface and terminating at the second distance from the valve assembly center portion, and a compressed air inlet port extending between the compressed air inlet terminus and the base plate bearing surface.

The valve assembly also includes a rotating valve port plate, which also includes a bearing surface adapted to engage the valve base plate bearing surface. The rotating valve port plate includes an arcuate vacuum port having first and second ends. The arcuate vacuum port is disposed in the port plate bearing surface at the first radial distance from the valve assembly center portion. Finally, the valve port plate also includes an arcuate compressed air port in the port plate bearing surface, which is disposed at the second radial distance from the valve assembly center position. The valve base plate and rotating valve port plate bearing surfaces rotatingly engage one another. During a single rotation of the port plate, the arcuate vacuum port provides fluid communication between the vacuum inlet port and the vacuum outlet port of the base plate to provide a vacuum through the compression/vacuum outlet to the vacuum cup. As the port plate continues to rotate within a single revolution, the arcuate compression port provides fluid communication between the compressed air inlet port and the compressed air outlet port to provide compressed air to the vacuum cup through the compression/vacuum outlet after vacuum delivery is completed.

Circumferential position adjustment of the base plate in the opposite direction of port plate rotation advances vacuum timing so that the vacuum inlet port of the base plate intersects a leading edge of the vacuum air supply port of the rotating port plate earlier within a single carton acquisition cycle to compensate for increased machine speed. Circumferential position adjustment of the base plate in the direction of port plate rotation retards vacuum timing so that the vacuum inlet port of the base plate intersects a leading edge of the vacuum air supply port of the rotating port plate later within a single carton acquisition cycle to compensate for decreased machine speed.

Additional features which can contribute to the overall carton feeder efficiency include improvements to the magazine assembly which optimize carton delivery to the selector assembly. A carton metering device can be incorporated with the above inventions to deliver cartons to the selector in a controlled manner, which creates a gap or separation in the carton stream that results in reduced pressure by the carton stack on the leading carton, which is the carton being selected. Additionally, the increased efficiency at which the selector assembly operates permits the magazine to include additional or modified components that provide increased support to and alignment of the cartons, such as support blades and retaining clips which contact the leading carton over more surface area than in known magazines. These improvements enable the carton feeder to accommodate imperfectly formed cartons, such as bowed or warped cartons. These and other features of the present invention will become apparent upon reading the following specification, when taken in conjunction with the accompanying drawings.

DETAILED DESCRIPTION OF THE INVENTION

Figure 1:
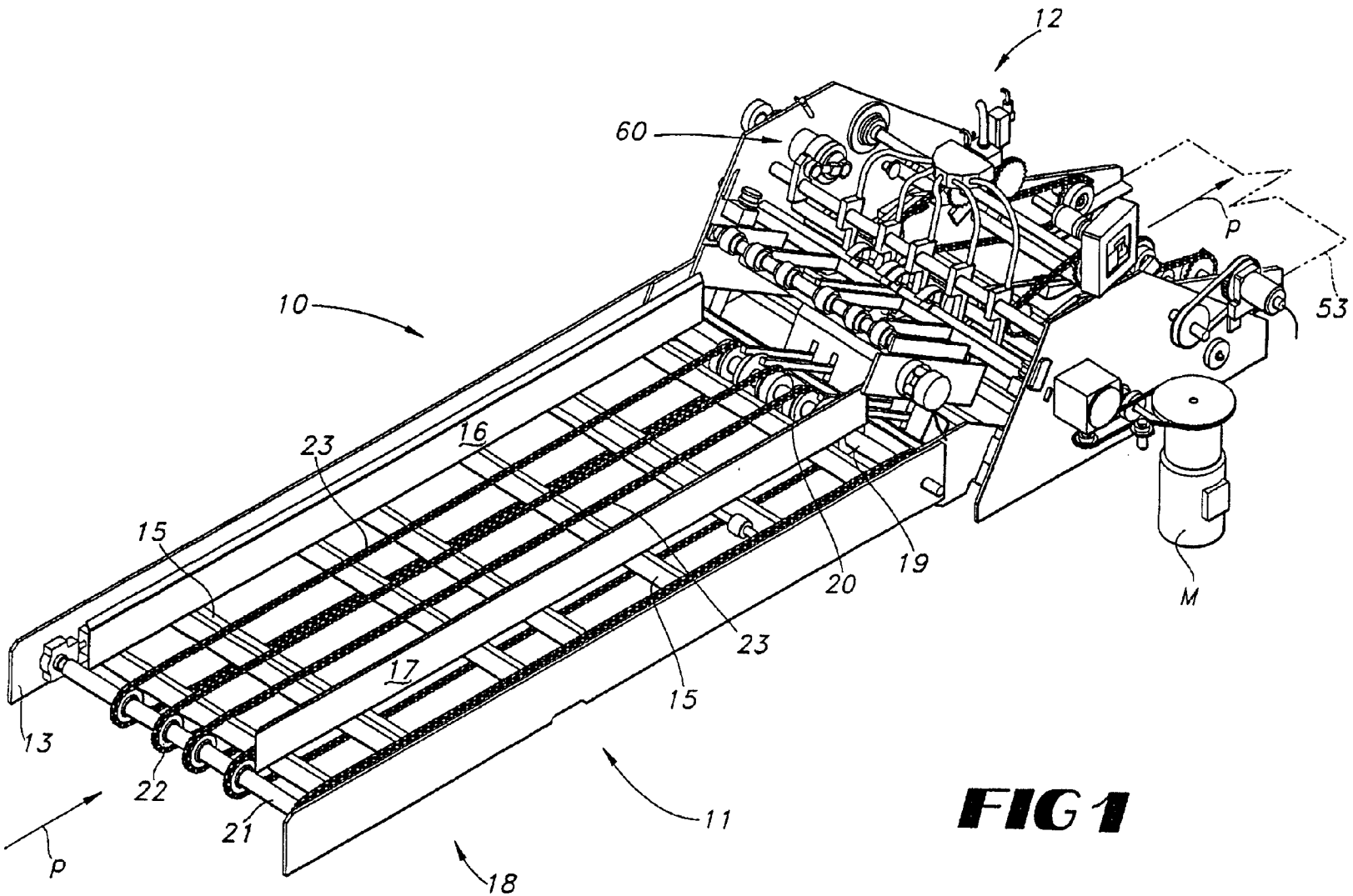
FIG. 1 is a perspective view of the carton feeder assembly of the present invention.

Referring to the drawing figures in which like reference numerals designate the same elements throughout the several views, FIG. 1 illustrates a segmented wheel carton feeder 10, comprised of a carton magazine 11 and carton selector assembly 12. Carton feeder 10 is intended to be used in conjunction with known, continuous motion packaging machines (not shown) in which cartons or carton blanks are delivered from the carton feeder to the next workstation of the packaging machine. The carton feeder defines a longitudinal path P shown by arrows, indicating the carton feeder's downstream direction. Carton magazine 11 includes many features of known magazines, including side plates 13 and 14, cross bars 15, transversely adjustable carton alignment plates 16 and 17 and carton conveyor assembly 18. One alignment plate, such as plate 17, can be eliminated, if desired, since the magazine will perform well with a single alignment plate. As is known in the art, the carton magazine conveyor assembly 18 is used to selectively advance a stack of folded cartons or carton blanks placed between plates 16 and 17, in the downstream direction along path P toward carton selector assembly 12. Conveyor 18 can comprise any type of known conveyors, such as belts or chains. FIG. 1 illustrates a chain-type carton conveyor of a type well known in the art. As also is known, this type of conveyor can be controlled using a sensor and conveyor drive assembly which automatically will advance the cartons toward the selector 12 on an as-needed basis. Conveyor assembly 18 includes a drive (not shown) driving a head shaft 19 with sprockets 20, and a tail shaft 21 with sprockets 22. Conveyor chains 23 pass around sprockets 20 and 22, and support the cartons (not shown) for movement toward the selector 12.

Figure 2A:
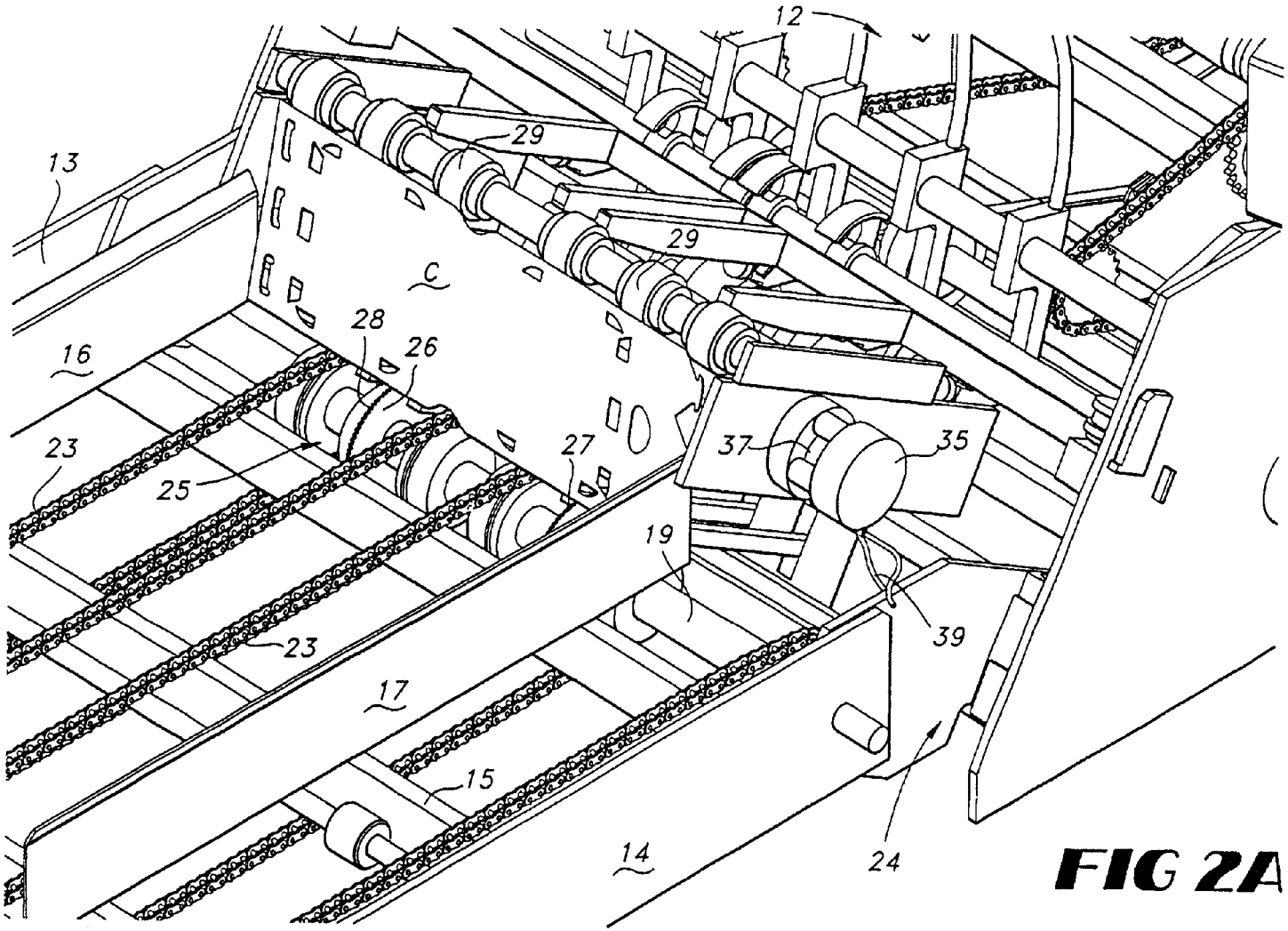
FIGS. 2A–2C are enlarged, perspective views of the metering device of the carton feeder assembly of FIG. 1.
Figure 2B:
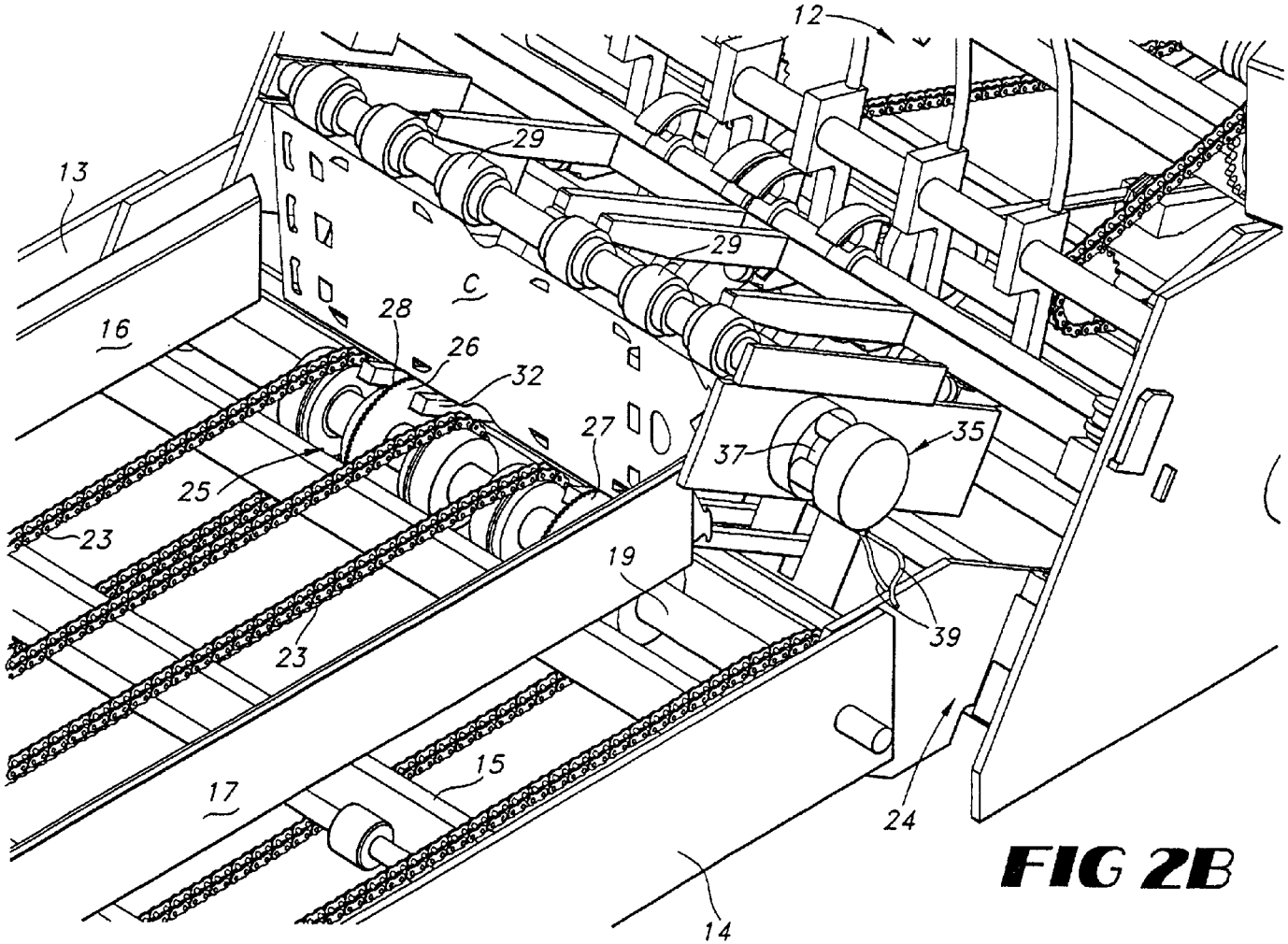
Figure 2C:
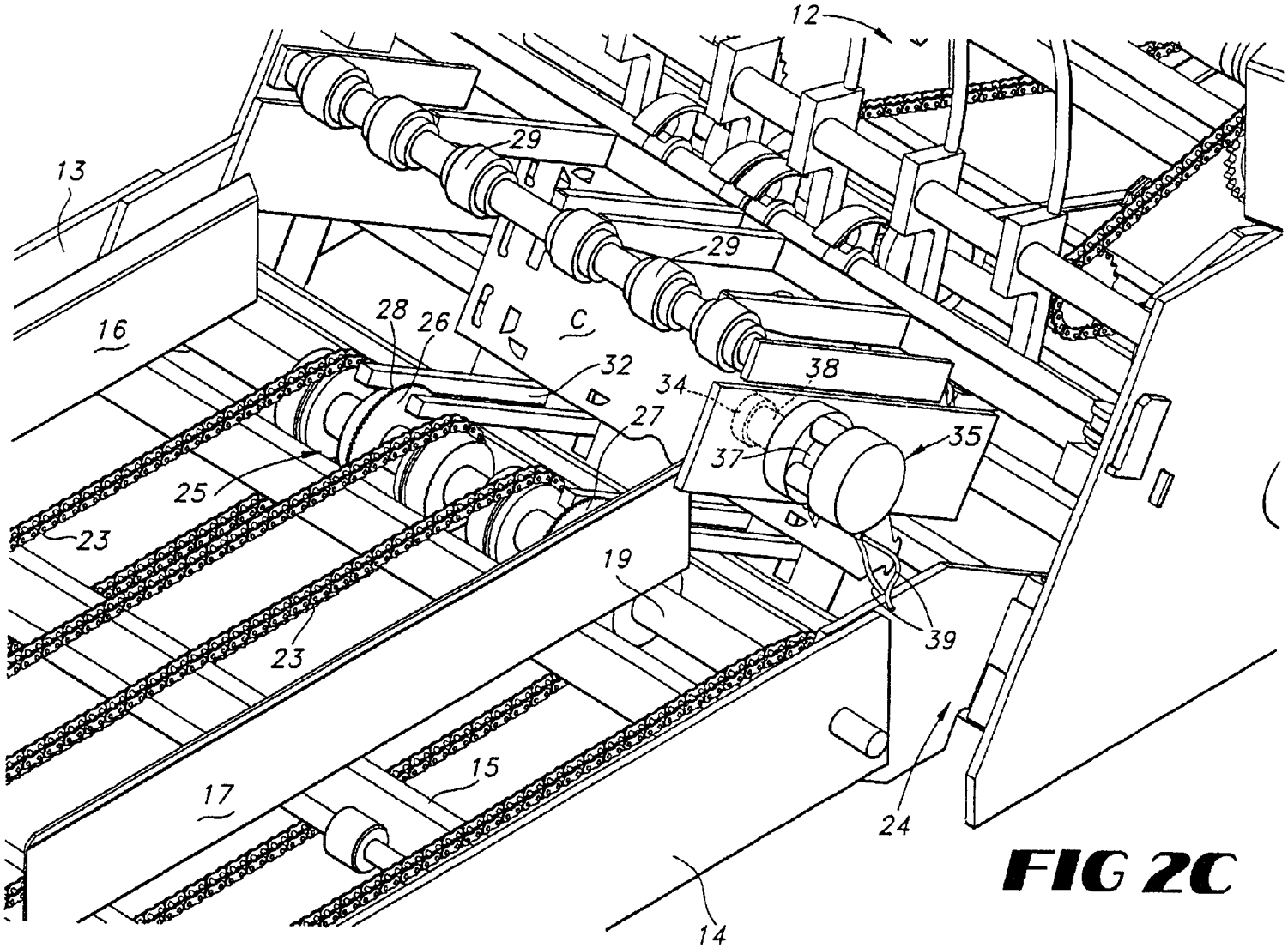

FIGS. 2A–2C show the leading or downstream end portion 24 of magazine 11, and specifically illustrates that magazine forward end portion 24 slopes downwardly toward selector assembly 12, also as known in the art. In the present invention, this downward sloping end portion 24 is approximately 30° from horizontal, however, this exact slope is not critical to the operarability of the present invention. The present invention can include a metering assembly, which selectively meters cartons C to the forward end portion 24, and a carton selection zone. The metering assembly 25 includes a star wheel 26, which also is supported by shaft 19. Metering assembly 25 also can include more than one star wheel, such as star wheel 27, FIG. 2B. Each star wheel includes serrations 28 defined along their respective peripheries. As shown in FIG. 2B, the serrated peripheries of star wheels 26 and 27 are at positions or heights above the level of chains 23 of conveyor assembly 18. Although star wheels 26 and 27 are shown supported by shaft 19 so as to turn along with shaft 19, the star wheels of metering assembly 25 could be supported and driven by a separate shaft. It is important, however, for the star wheel peripheries to be at a level above the conveyor assembly, such as chains 23, of conveyor assembly 18 as shown in FIG. 2B, so that as the cartons are conveyed by chains 23 in a downstream direction to contact the star wheels 26 and 27, the cartons are sequentially contacted by serrations 28 as star wheels 26 and 27 turn toward the downstream direction of path P, which raise the cartons with respect to chains 23 so that cartons C lose contact with chain 23. Metering assembly 25 also includes rollers 29 freely turning on shaft 31, which is positioned above and slightly forward or downstream of shaft 19. Although six rollers 29 are shown to illustrate the present invention, the number of rollers could be increased or reduced, as long as the cartons leaning on rollers 29 are well supported and do not bend or bow as a result of back pressure from other cartons in the carton stack on the conveyor assembly 18. Additionally, the separate rollers 29, as shown in FIG. 2B, could be replaced by one elongate roller extending along substantially the entire length of shaft 31.

As star wheels 26 and 27 continue to turn in the downstream direction, the carton or cartons contacting wheels 26 and 27 are raised above chains 23 until the cartons reach a position above the sloping bars 32. The leading carton then will slide forwardly and downwardly along slide bars 32 toward the carton selection zone. In this manner, a controlled number of cartons C are held in the magazine forward end portion 24, that is downstream of metering assembly 25, which prevents an unacceptable amount of force against the leading carton in the selection zone, by creating a gap between the cartons held in the forward end portion 24 and those in the stack of cartons (not shown) beginning at the carton metering assembly 25 and extending rearwardly in an upstream direction along conveyor assembly 18. As will be discussed herein, the metering of cartons C contributes to the efficiency of which the present invention performs, by controlling the force exerted on the leading carton at the selection zone by the trailing cartons in magazine forward position 24.

The magazine assembly 11 of the present invention also can include an alignment mechanism or tamping assembly 35, which is mounted to side plate 36, FIG. 2C. Tamping assembly 35 is comprised of a conventional dual action air cylinder 37 which drives a rod 38, in this instance the forward end of which is an enlarged end portion 34, toward and away from cartons C held in the magazine forward end portion 24. The cylinder 37 is driven by pressurized air through pressure lines 39 from a pressure source (not shown). The tamper is reciprocated so that it repeatedly contacts the cartons by tamping the side edges of cartons C which are adjacent to it, pushing the cartons toward opposing side plate 43. In this manner the cartons C are kept in alignment as they progress consecutively toward the selection zone.

Figure 3:
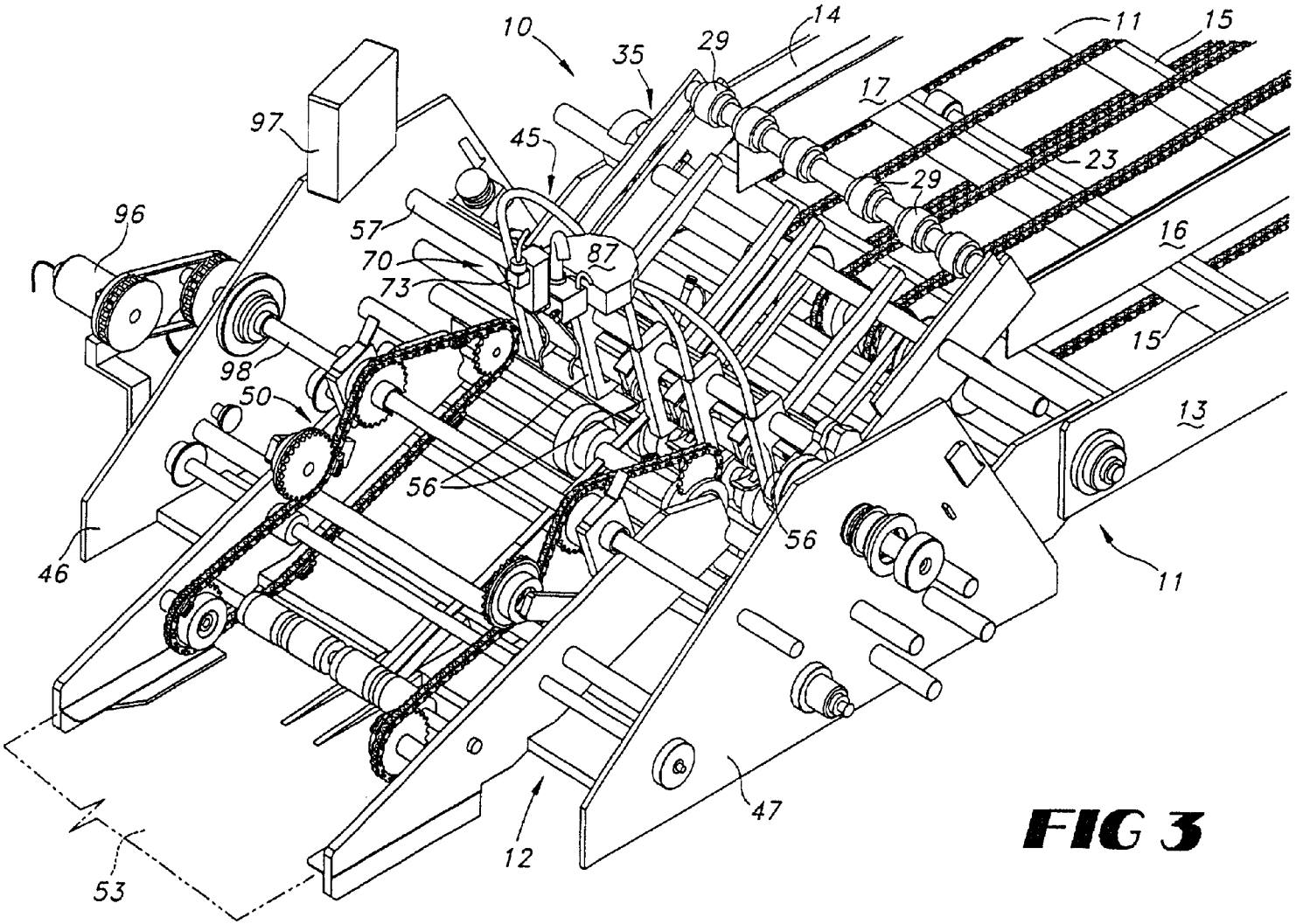
FIG. 3 is a rear, perspective view of the selector assembly of the carton feeder assembly of FIG. 1.

FIG. 3 illustrates the carton selector assembly 12 of carton feeder 10. Carton selector assembly 12 is a segmented wheel-type carton selector, the principal elements and operation of which are well known to those skilled in the art, and disclosed in representative forms in the patents to Sherman and to Olsen Jr. et al., respectively. Selector 12 includes side plates 46 and 47, between which are the picking and transport components of selector 12. As shown in FIG. 3, selector 12 is positioned at the magazine downstream end 24. Selector 12 includes a picking assembly 45 which picks or removes cartons C sequentially from magazine 11 at the carton selection zone Z (FIG. 4A), and positions the carton to be contacted by segmented wheels 48 (FIGS. 4A–4D). The segmented wheels 48, in conjunction with nip roller 49 pull carton C from magazine 11 and transfer the single carton to a second set of nip rollers 51 and 52. Selector 12 also includes a known type of chain conveyor 50 which receives the carton from nip rollers 51 and 52 and moves the carton further downstream to packaging machine carton conveyor 53, shown in phantom lines, which transfers the cartons to the next workstation downstream in the packaging machine. These above-described components of selector 12 and their methods of operation are well known in the art and so not further described herein. As also is known in the art, these components are driven from a main drive motor M, and through appropriate gearing and mechanical interconnection through drive chains, are all driven at the desired speeds and ratios to one another by motor M or from the packaging machine main drive assembly (not shown), as is known in the art.

Figure 4A:
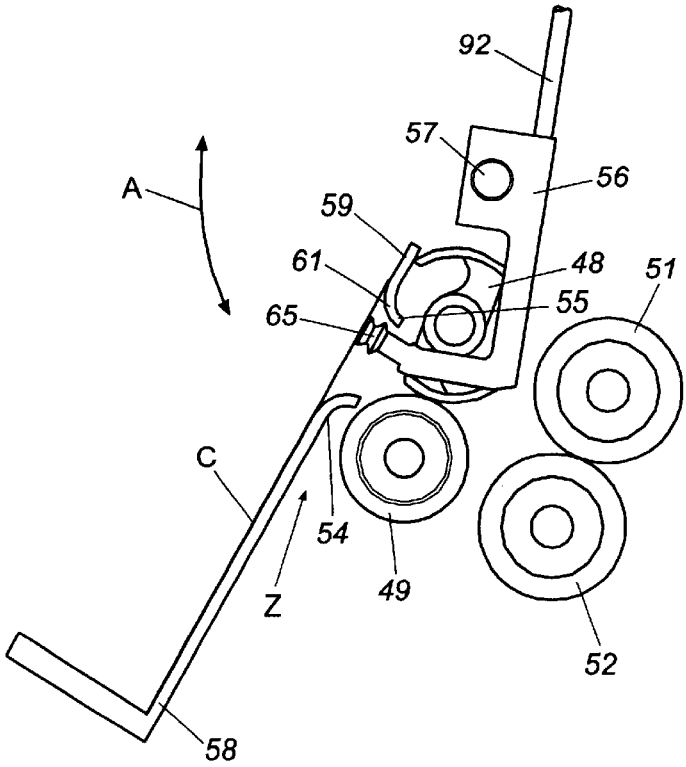
FIGS. 4A–4D are schematic representations of the picking assembly of the carton feeder of assembly of FIG. 1.
Figure 4B:
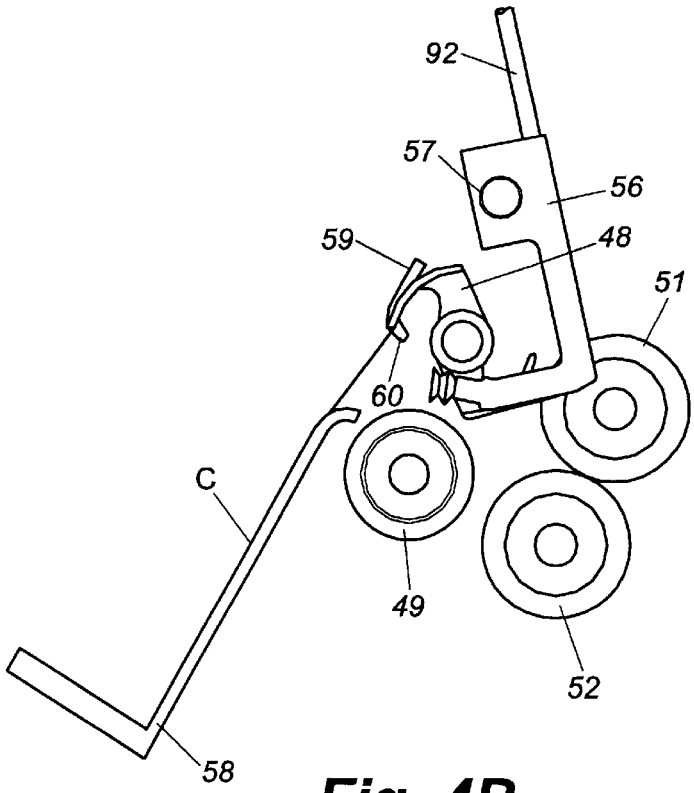
Figure 4C:
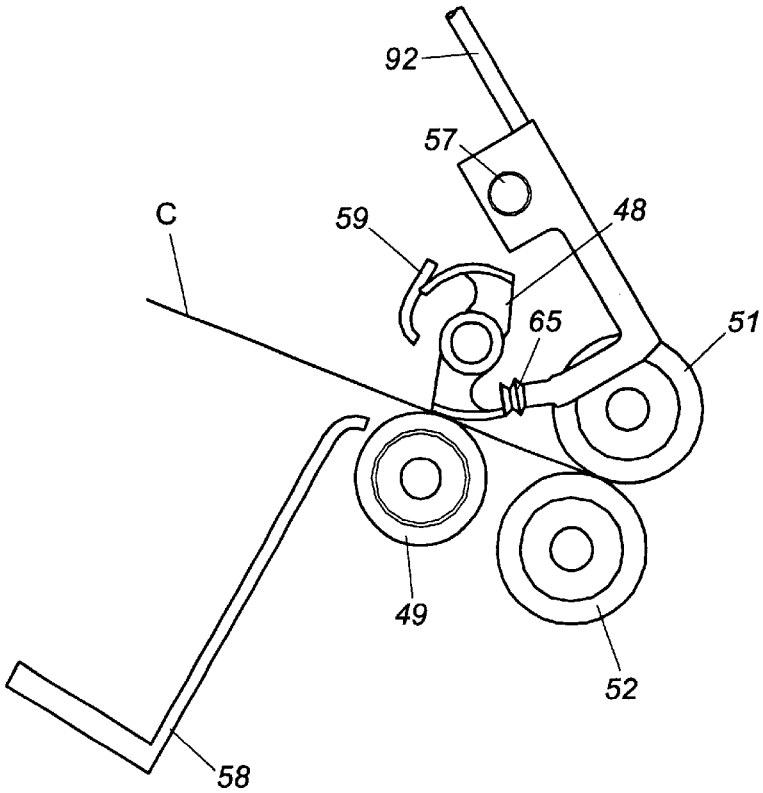
Figure 4D:
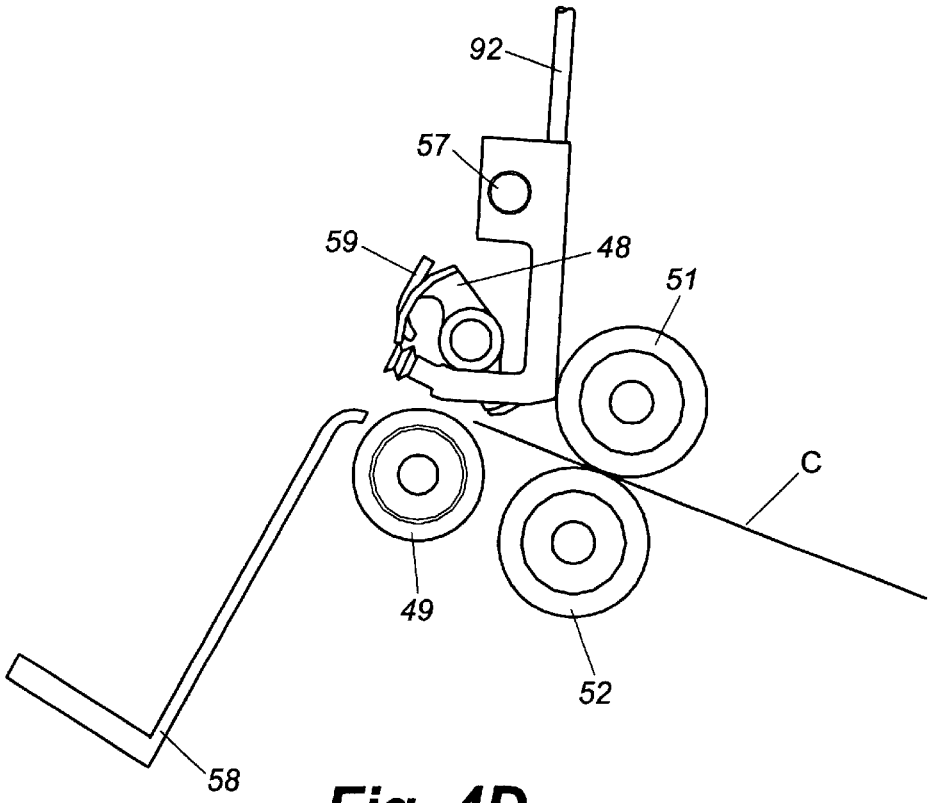

FIGS. 4A–4D show the picking and removal of a single carton C by selector 12. This operation, and the principal components for carrying out this operation generally are substantially the same for all known segmented wheel feeders, although they differ slightly in form in known feeders of this type. In FIG. 4A, picking assembly 45 includes L-shaped lever 56 which is fixed to reciprocating shaft 57 and driven by motor M through appropriate chains or gears through pinion assembly 60 to reciprocate back and forth in the direction of arrow A toward and away from magazine forward end 24. At the forwardmost or leading end portion of magazine forward end 24 is a lower plate or blade 58 and an upper retaining plate or clip 59 spaced from lower blade 58 which together support the leading carton C, as shown in FIG. 4A, with trailing cartons (not shown) contained in magazine forward end 24 behind or upstream of the leading carton. The upper end 54 of blade 58 curves in the downstream direction toward the carton selector. Similarly, the lower end 55 of retaining clip 59 also curves outwardly in the downstream direction, as shown in FIG. 4A. Lower blade 58 and clip 59 preferably extend the entire width of end portion 24, to provide strong support for cartons C. The vertical gap between blade 58 and clip 59 is approximately 2 to 2½inches. The space between lower support blade 58, upper retaining clip 59 and segmented wheels 48 defines a selection zone Z, which is the position at which the leading carton C is picked and removed from magazine forward end 24. As is well known, numerous spaced levers 56 can be positioned along shaft 57 between side plates 46 and 47.

A vacuum/pressure cup 65 is positioned on the lower, distal end portion of each L-shaped lever 56, as shown in FIGS. 4A–4D. As is described herein, at the appropriate feeder positions vacuum or pressurized air are delivered to cups 65 in order to effect the attachment and/or release of cups 65 to leading carton C. FIG. 4A shows a lever 56 pivoted in the clockwise direction towards selection zone Z until cup 65 contacts the leading carton C. As is known in the art, at this position vacuum has been delivered to the cup so that cup 65 attaches to leading carton C. Lever 56 then is pivoted in a counterclockwise direction (FIG. 4B) away from selection zone Z while cup 65 is still attached to carton C, until the upper portion of carton C is pulled downstream, away from upper retaining clip 59 so that the carton upper edge 61 is released from magazine forward end 24. As will be discussed hereinafter, pressurized air is delivered to vacuum cups 65 at this position to release carton C from the cups 65. The upper portion 60 of carton C will contact curved end 55 of clip 59 to position carton C to be contacted by wheel 48. Segmented wheel 48 has been rotated so that after release of carton C from cup 65, a segment or cut out portion 62 contacts upper edge 61 of carton C and bends carton C downwardly towards nip roller 49. Further rotation of segmented wheel 48 (FIG. 4C) positions carton C between nip roller 49 and the arcuate circumferential surface 63 of segmented wheel 48. As carton C is pulled between the circumference of nip roller 49 and surface 63 of segment wheel 48, the further counterclockwise rotation of segmented wheel 48, from the perspective illustrated in FIGS. 4B–4C causes the opposite rotation to nip roller 49 which pulls carton C in the downstream direction until it is fully released from magazine 11. At this feeder position, carton C is forced between rollers 51 and 52 (FIG. 4D), one or both of which are driven to pull carton C away from selection zone Z, where the carton is thereafter transferred to chain conveyor 50. Chain conveyor 50 with upstanding lugs (not shown) then moves carton C further in the downstream direction, where carton C is transferred to packaging machine carton conveyor 53. These components of selector 12 and their operation all are associated with known segmented wheel feeders and so not further described.

In addition to the modifications to the carton magazine described herein, the present invention comprises modifications to the carton selectors of known segmented wheel feeders in order to accomplish efficient carton selection at higher speeds. As selector speeds increase, the operational speeds of all components, which are mechanically tied together through drive chains (not shown) and driven from motor M must correspondingly increase. Consequently, the timing of the delivery of the vacuum and pressurized air, respectively, to cups 65 must be maintained precise at all speeds. Both vacuum and pressurized air must be delivered to the cups from vacuum and pressurized air sources, respectively, and through vacuum lines in each selector cycle. A selection cycle is the removal of a single carton C from magazine 18 by selector 12, and at speeds of over 400 cartons per minute, may be approximately 100–120 milliseconds.

To accomplish such precise vacuum and air delivery, the present invention utilizes a solenoid valve assembly electronically connected to a speed compensation assembly. In order to selectively deliver either vacuum or pressurized air to cups 65 at precise selected positions, the dual solenoid valve assembly 70 is utilized. Valve assembly 70 includes a vacuum valve 71 coupled to a separate pressure valve 72. Valves 71 and 72 are air piloted, three way solenoid valves with large CD valves (approximately 5) well known in the art. The valves utilized in the present application are manufactured by MAC Valves Incorporated of Wixom, Mich. These valves are electronically controlled by electronic valve controller 73 supplied by Electro Cam Corporation of Roscoe, Ill. Vacuum valve 71 is supplied with vacuum through vacuum supply line 74 connecting valve 71 with vacuum source 75 which delivers vacuum at approximately 25–28 inches of mercury. Similarly, pressurized air valve 72 is supplied with pressurized air at up to approximately 80 p.s.i. through inlet line 76 from pressure source 77. Air valve 72 includes inlet port 78, and outlet ports 79 and 80, respectively. As shown in FIG. 5A, outlet port 79 is capped by plug 81 to completely close off port 79. Outlet port 80 of valve 72 is connected to inlet port 82 of vacuum valve 71 through connecting line 83.

Vacuum valve 71 includes vacuum inlet port 84 and vacuum/air outlet port 85. Outlet port 85 is connected through line 86 to distribution manifold 87. Distribution manifold 87 includes inlet port 88 and is internally drilled with main bore 89 and five secondary bores 90. Bores 90 are of the same cross-sectional area in order to equally distribute vacuum or air, respectively. Secondary bores 90 terminate in outlet ports 91, which are connected through lines 92 to cups 65. Although the present invention illustrates an embodiment which includes five levers 56 each having a cup 65 supplied from a distribution manifold distributing vacuum or air to five lines 92, the present invention is not limited to a five cup arrangement, but could be utilized with various numbers of vacuum cups distributed with vacuum or air from a distribution manifold. As shown in FIG. 1, distribution manifold 87 is mounted in relatively close proximity to vacuum cup 65. Preferably, the positioning of valve assembly 70 and distribution manifold 87 with respect to cups 65 should result in the length of vacuum/air lines 92 being four to five inches in length or less, in order to assist in optimum control of the delivery of vacuum and/or pressurized air to cups 65.

The switching of vacuum valve 71 and pressure valve 72 to different valve positions is accomplished by electronic valve controller 73, which, in turn, is controlled by speed compensating assembly 95. Speed compensating assembly 95 is comprised of an encoder, such as a shaft angle encoder 96, which is electrically connected to a programmable limit switch (PLS) 97. PLS 97 is electronically connected to valve controller 73. Speed compensating assembly 95 can be of the Plus PS-6144 series of programmable limit switches also supplied by Electro Cam Corp. Encoder 96 is driven from shaft 98 of selector 12. Shaft 98 is part of carton conveyor 50, and turns one revolution every selector cycle, although encoder 96 can be driven from or read the position of any rotating shaft of selector 12, since all such rotating shafts are tied together mechanically. If encoder 96 is driven by or reads the rotation of any shaft which rotates on a ratio other than 1:1 with respect to the selector cycle, that ratio must be considered in programming the PLS, as is known to those of skill in the art. The encoder 96 reads the position of shaft 98, which position is relative to the positions of all other moving components of selector 12, since all moving components are mechanically tied together by chains or gears (not shown). The encoder electronically signals the PLS of the "selector position," which relates to the angular position of the shaft tied to the encoder, so that the encoder reads the relative position from the shaft and sends that information to the PLS, which determines when to switch valves 71 and 72, respectively.

As a starting point, the PLS is manually programmed to initiate valve shifting at a desired position of the selector components, such as the position of levers 56 and cups 65 contacting the lead carton C in the magazine at the selection zone. This initial shifting information is the basis from which the PLS uses to calculate valve shifting at different feeder speeds. As is known in the art, the PLS can calculate the selector assembly speed based upon the angular movement of the monitored shaft through a time interval. The PLS controls valves 71 and 72 to "open and close" or switch valve positions based upon the speed of selector 12, which relates to the position of any of the selector's rotating shafts during a selector cycle.

Considering that a determinable amount of time is required for valves 71 and 72 to switch and for either vacuum or pressurized air, respectively, to flow through valves 71 or 72, distribution manifold 87 and supply lines 92 to cup 65, valves 71 and 72 must be switched at various positions or times in relation to a selector assembly cycle, so that either vacuum or pressurized air is delivered to cups 65 at the precise feeder position to accomplish efficient selector operation at any selector speed. For example, a quantifiable time is required for vacuum to travel from vacuum valve 71 to cups 65. This is determined by trial and error, and is dependent upon many variables, including whether vacuum or air is being delivered, the size and length of supply lines 72, and the size of the bores 89 and 90 of distribution manifold 87. Additionally, the time required for vacuum valve 71 to shift from one position to another either is supplied by the valve manufacturer or determined by trial and error. Typically it requires approximately 12 milliseconds for valves 71 and 72 to shift. Once these values are determined, that is the time required for vacuum flow from valve 71 to cup 65 and the time required for valves 71 or 72 to shift, these times are added and the total value is input or programmed into the PLS as a speed compensation factor. For example a factor could be 26 milliseconds to shift valve 71 and deliver vacuum to cups 65.

Based upon this input value, the position (equating to speed) data delivered to the PLS by the encoder, and the initial shifting information manually programmed into the PLS, the computer in the PLS calculates when the vacuum valve 71 should be switched, typically relating to degrees of selector position in relation to 360° at any selector speed. The same calculations also take into account the time required for pressurized air to travel from pressure valve 72 to cup 65 and the time required to shift pressure valve 72, which allows for similar control of pressure valve 72 by PLS 97 through valve controller 73. Therefore, the PLS considers the selector speed that it receives from the encoder, relating to the position of selector 12, in determining how soon in advance to electronically switch the appropriate valve so that either vacuum or pressurized air arrives at cup 65 at the same relative selector position, regardless of the selector speed. Therefore, the valve control is accomplished linearly with respect to machine speed. In other words, the valve switching will be advanced or retarded based upon precise selector position, which relates to selector speed. It also is possible, however, to program the PLS to signal the appropriate valves to switch based upon when a selector speed threshold is reached. For example, the PLS could advance or retard valve actuation when the selector reaches thresholds such as 300 cartons per minute (c.p.m.), 350 c.p.m., 400 c.p.m., and so forth. This would be a "stepped" valve actuation as opposed to the linear valve actuation described above, and may be acceptable in certain applications.

Figure 5B:
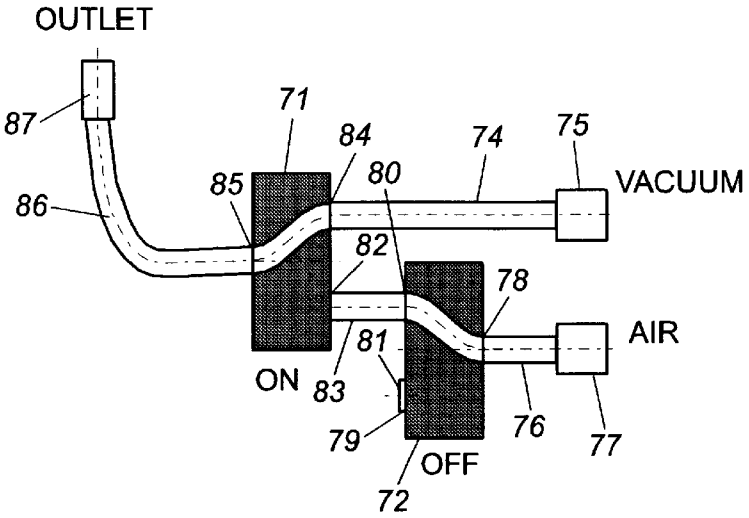
FIGS. 5A–5D are schematic side views of the valve assembly in different cycle positions of the carton feeder of FIG. 1.
Figure 5A:
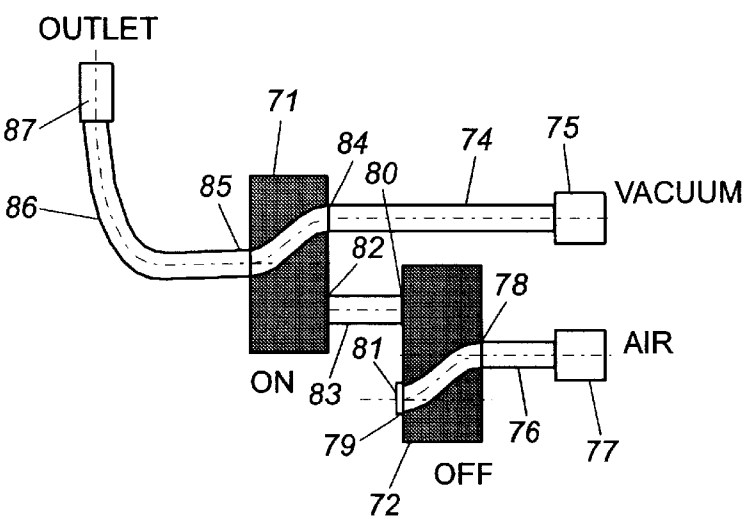
Figure 5D:
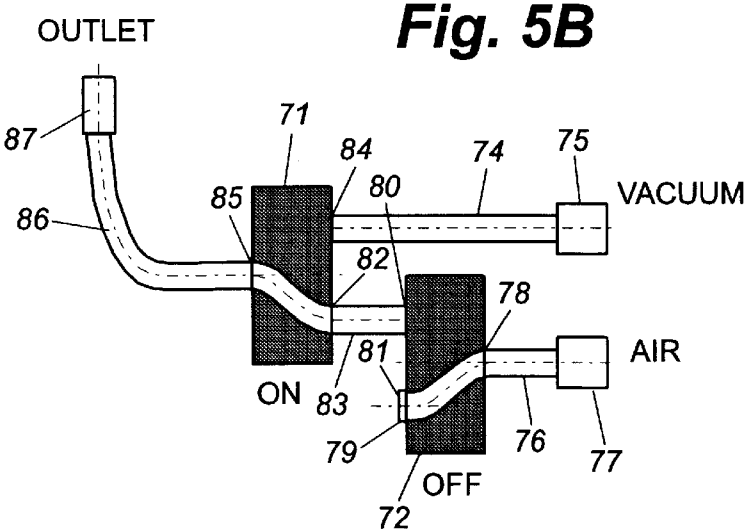
Figure 5C:
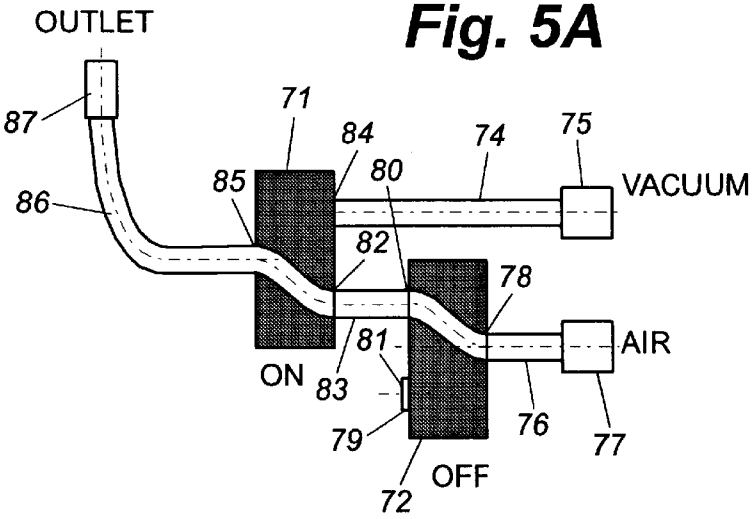
Figure 6:
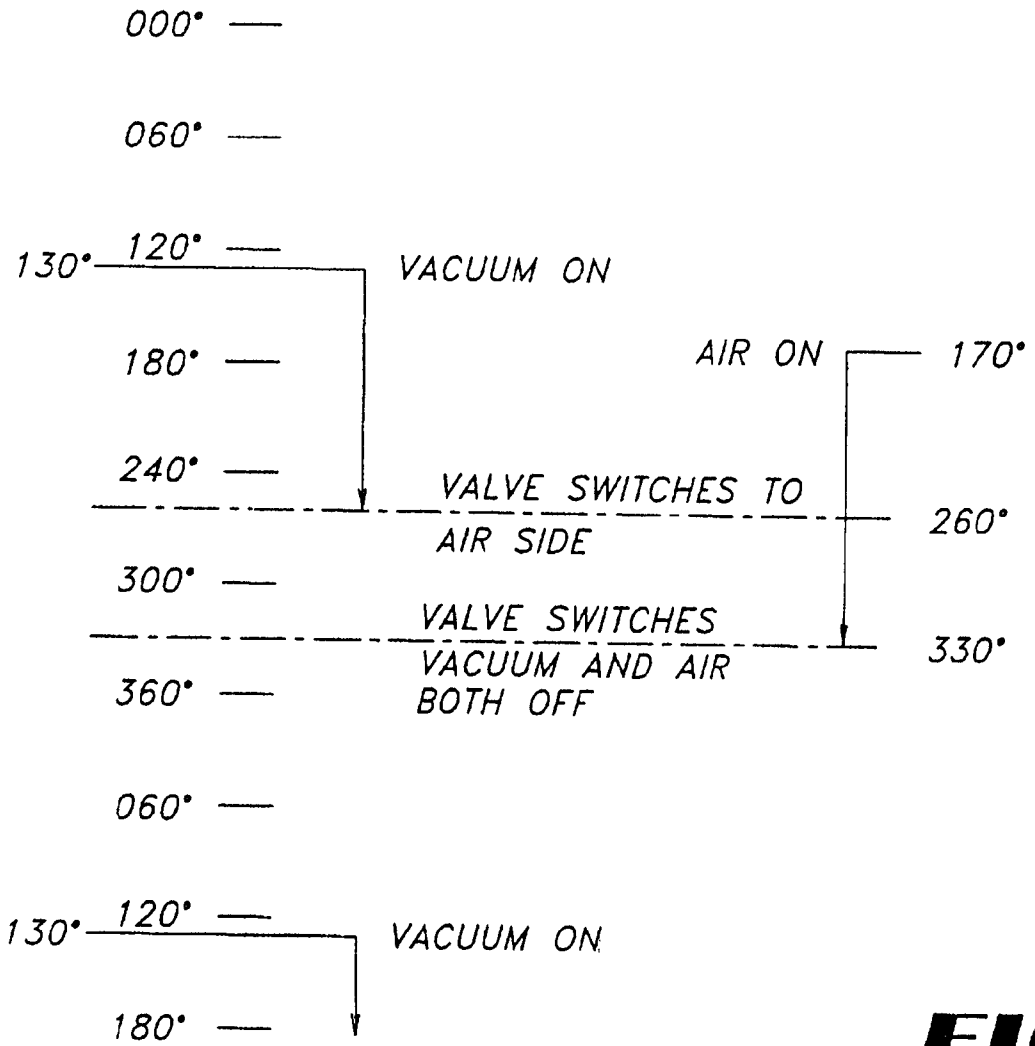
FIG. 6 is a graphic representation of the feeder positions and related actuation of the valve assembly of FIG. 5A.
Figure 7:
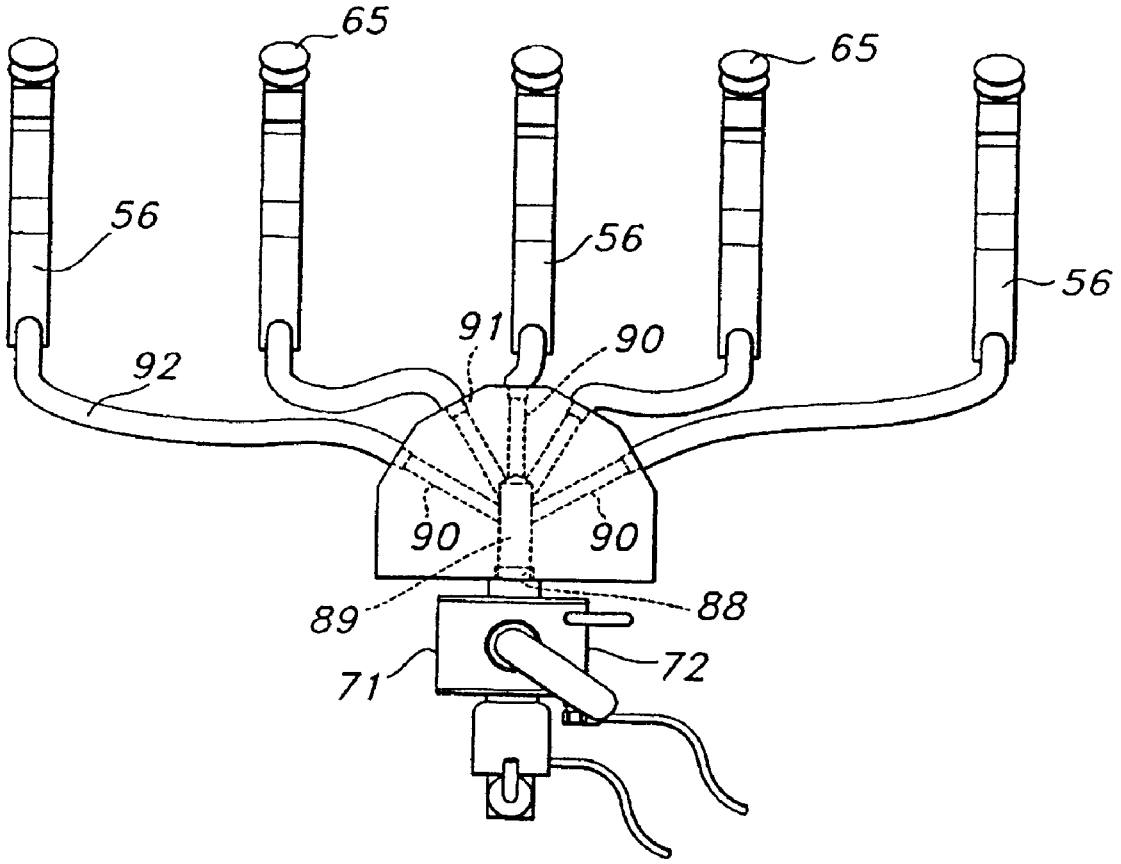
FIG. 7 is a schematic representation of the manifold, and vacuum/pneumatic line and vacuum/pressure cups of the assembly of FIG. 1.

FIG. 5B graphically illustrates one example of linear valve control at a particular feeder speed. This graph is for illustrative purposes, only, of one embodiment of the present invention. The values exemplified in FIG. 5B will change for other embodiments depending on many variables, for example, the selector starting position, selector geometry, valve shift time, and pneumatic piping characteristics. The PLS first is "homed" or "initialized" by utilizing a sensor, such as an optical sensor, which reads the position of a selector element, such as lever arm 56. In the present embodiment, a sensor 99 detects lever arm 56 at a specific position, and sends an electronic signal to the PLS to set or initialize the PLS to a home or zero position on every selector cycle. This sensor, therefore, sets the timing of the PLS on each cycle. As the selector 12 is operated, shaft 98 turns, which drives encoder 96. When the position of shaft 98 reaches 130° from the feeder's zero position, which zero position equates to the detected position of lever 56 by sensor 99, PLS 97 signals controller 73 to switch valve 71 to vacuum inlet port 84, as shown in Position "A," FIG. 5A. At Position "A," the pressurized air valve 72 is switched to capped port 79 so that no airflows to vacuum valve 71. Therefore, at this position, vacuum flows from vacuum source 75 to cups 65. When selector, or shaft 98, reaches 170°, the PLS causes air valve 72 to switch from port 79 to port 80, as shown in FIG. 5A, Position "B." At this selector assembly position, however, vacuum is still being delivered to cups 65 since valve 71 is still switched to vacuum inlet port 84, with port 82 being "inactive." The switching of air valve 72 from port 79 to port 80 is made only to advance the valve action of valve 72 for the next step in the switching cycle, to eliminate the need to time the shifting of the valves 71 and 72 with respect to one another and to reduce the overall time required to accomplish delivery of pressurized air to cup 65. At 260°, the PLS causes controller 73 to switch valve 71 from port 84 to port 82, thus turning off vacuum delivery to cups 65 and turning on pressurized air delivery to cups 65, as shown in FIG. 5A, Position "C." This position equates to the point in the selector assembly cycle when pressurized air is desired in order to actively release cups 65 from carton C, that is when the upper edge 61 of carton C has been pulled below retaining clip 59. At 330°, the PLS through controller 73, causes valve 72 to switch from port 80 to port 79, as shown at Position "D." Therefore, at Position "D" neither vacuum nor pressurized air is supplied to cups 65, which allows atmospheric or ambient air to exist in supply lines 86 and 92 until the selector position again reaches 130°, at which point the PLS causes valve 71 again to switch from port 82 to port 84, delivering vacuum to cups 65 and beginning another valve cycle. Therefore, regardless of whether the selector assembly speed is increased or decreased, the valves 71 and 72 are switched at various, appropriate feeder positions necessary to accomplish delivery either of vacuum or pressurized air, respectively, to cups 65 at the appropriate position or selector cycle time.

This speed compensation becomes extremely important at higher selector speeds. For example, if one complete selector revolution requires approximately 100 milliseconds and the time required to shift either valve 71 or 72 and for either vacuum or pressurized air, respectively, to flow to cups 65 requires approximately 30 milliseconds, approximately one third of a selector revolution is required to shift the valve and deliver air or vacuum to the cups. At very high machine speeds, for example, approximately 400–600 cartons per minute, the timing is so critical that these actions must occur within ten to fifteen degrees of the ideal selector position.

Figure 8:
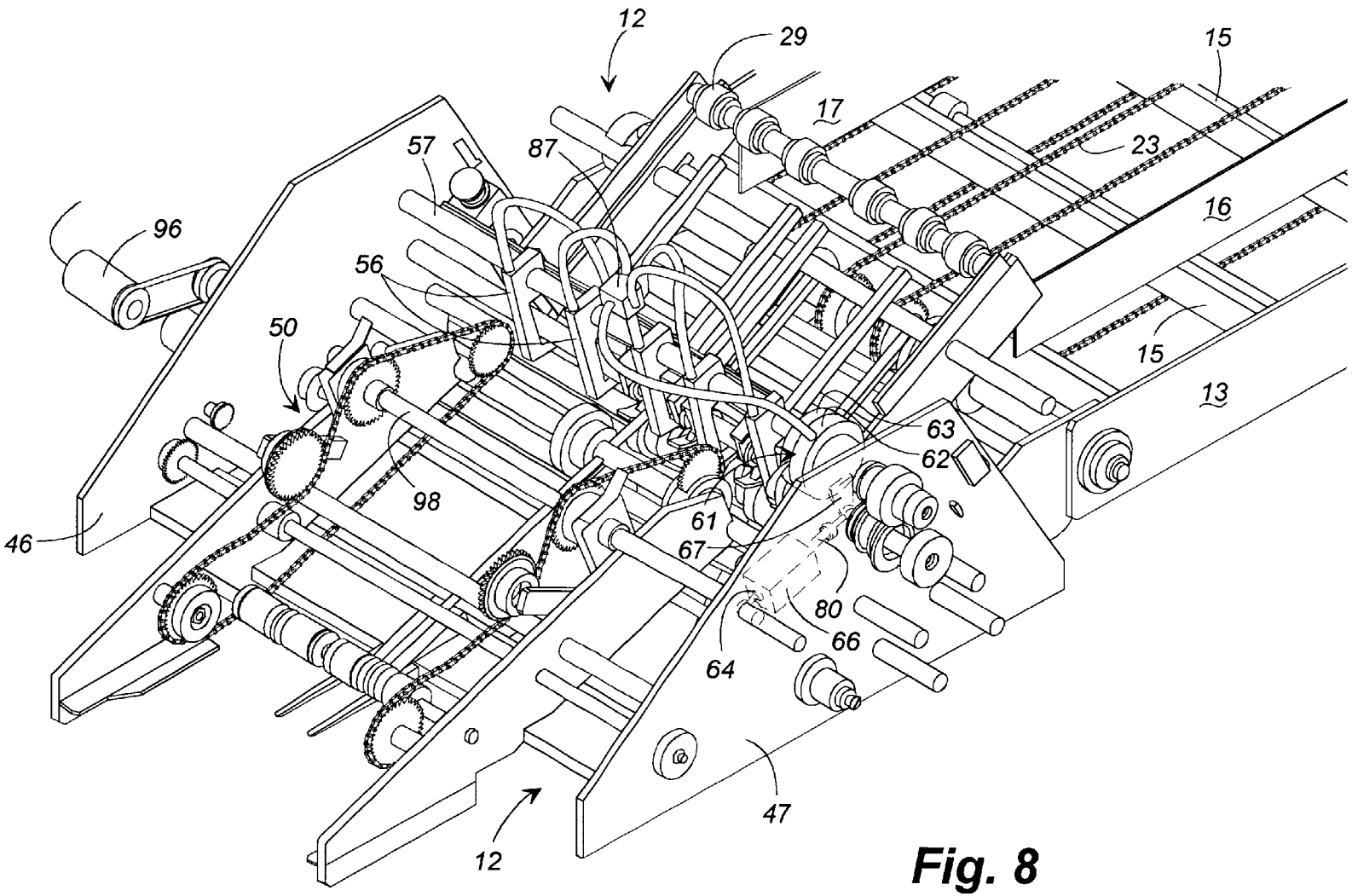
FIG. 8 is a rear, prospective view of an alternative embodiment of the carton feeder assembly of FIG. 1.
Figure 9:
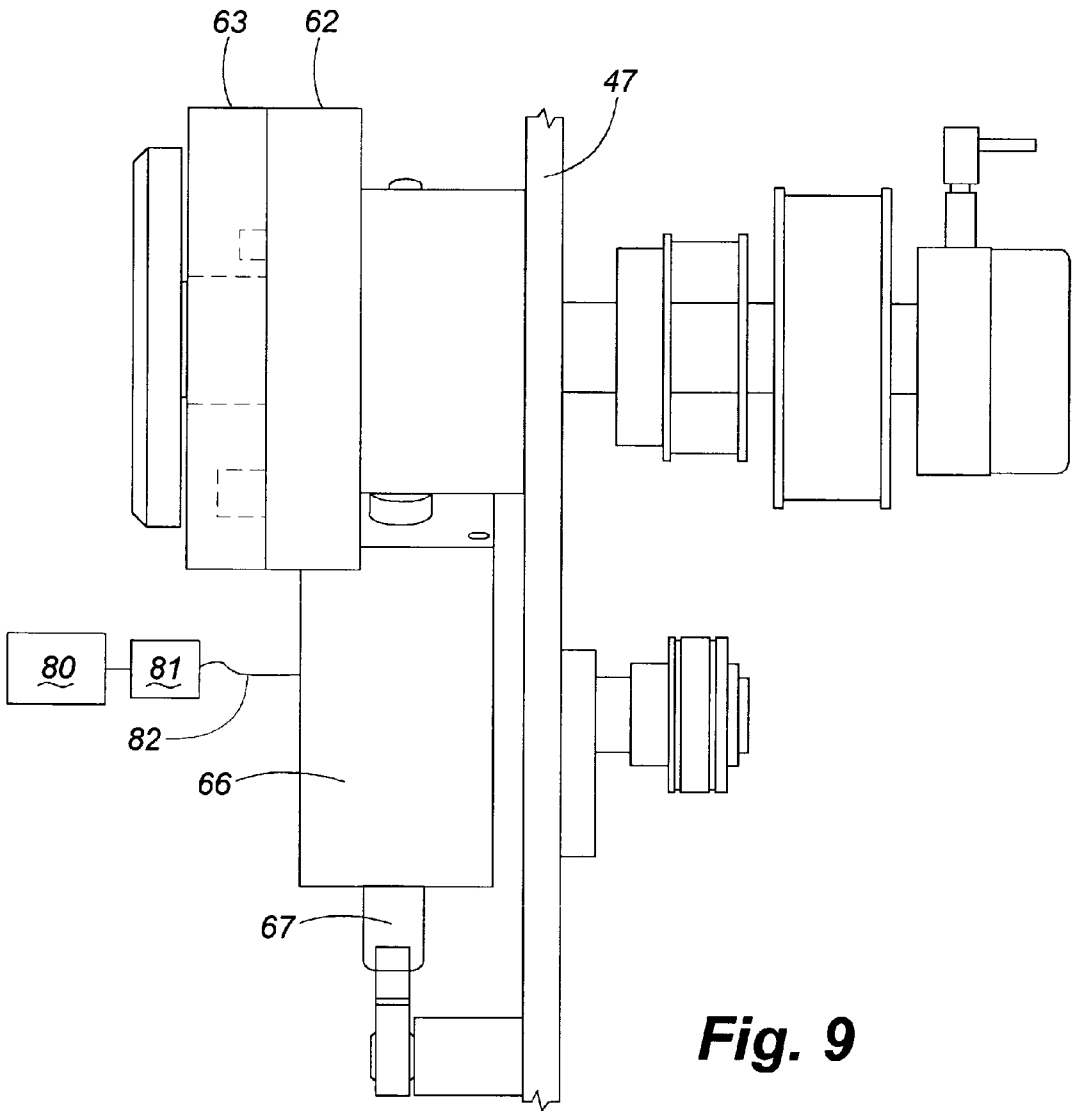
FIG. 9 is a front view of the valve assembly of the alternative embodiment of the present invention.

FIG. 8 illustrates an alternative embodiment of the carton feeder 10. In this embodiment, the carton-feeding machine is virtually the same as the first embodiment, except for the mechanism which advances or retards the application of vacuum and compression to the vacuum cups. For example, the carton assembly 12 is a segmented wheel-type carton selector, the principle elements and operation of which are well known to those of ordinary skill in the art and are disclosed in representative forms in the patents to Sherman and to Olsen, Jr. et al, respectively. The selector 12 includes the side plates 46 and 47 which are the picking and transport components of the selector 12. As is shown in FIG. 8, the selector 12 is positioned at the magazine downstream end 24. Selector 12 includes a picking assembly 45, which removes cartons from the magazine 11. The alternative embodiment also includes a mechanism for measure machine speed such as encoder 96 as is schematically illustrated in FIG. 8.

Focusing on the details of the alternative embodiment, FIG. 8 illustrates a valve assembly 101 selectively providing a vacuum and compression to vacuum cups 65 during a single carton selection cycle. The valve assembly 101 includes adjustable valve base 102 and a rotating valve port plate 103 disposed adjacent to the adjustable vacuum valve base 102. The valve base 102 includes a radial arm 104 extending radially outwardly therefrom for advancing or retarding vacuum/compression timing. A first cylinder 105 and a second cylinder 106 are mechanically coupled within housing 107 and between the machine and the radial arm 104 for providing circumferential adjustments to the valve assembly to advance or retard timing of the application of a vacuum to the vacuum cups 65 in response to the speed signal from encoder 96. The encoder 96 is coupled to a controller 108 which actuates a solenoid 109, which is connected via line 110 to the pneumatic cylinder assembly 107 for actuating the valve assembly 101.

Figure 11B:
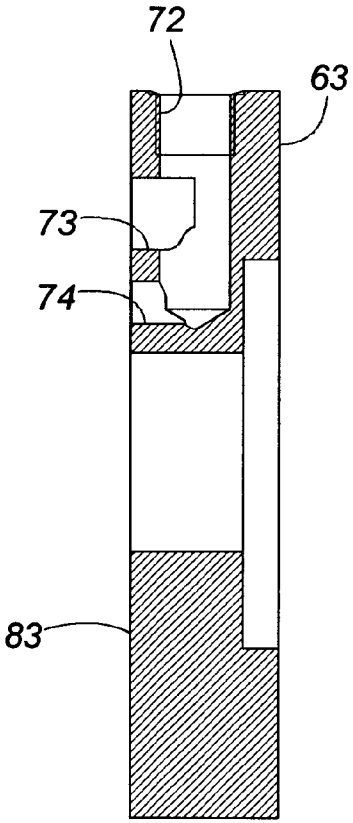
FIG. 11B is a cross-sectional view taken along line 11B—11B of FIG. 11A.
Figure 11A:
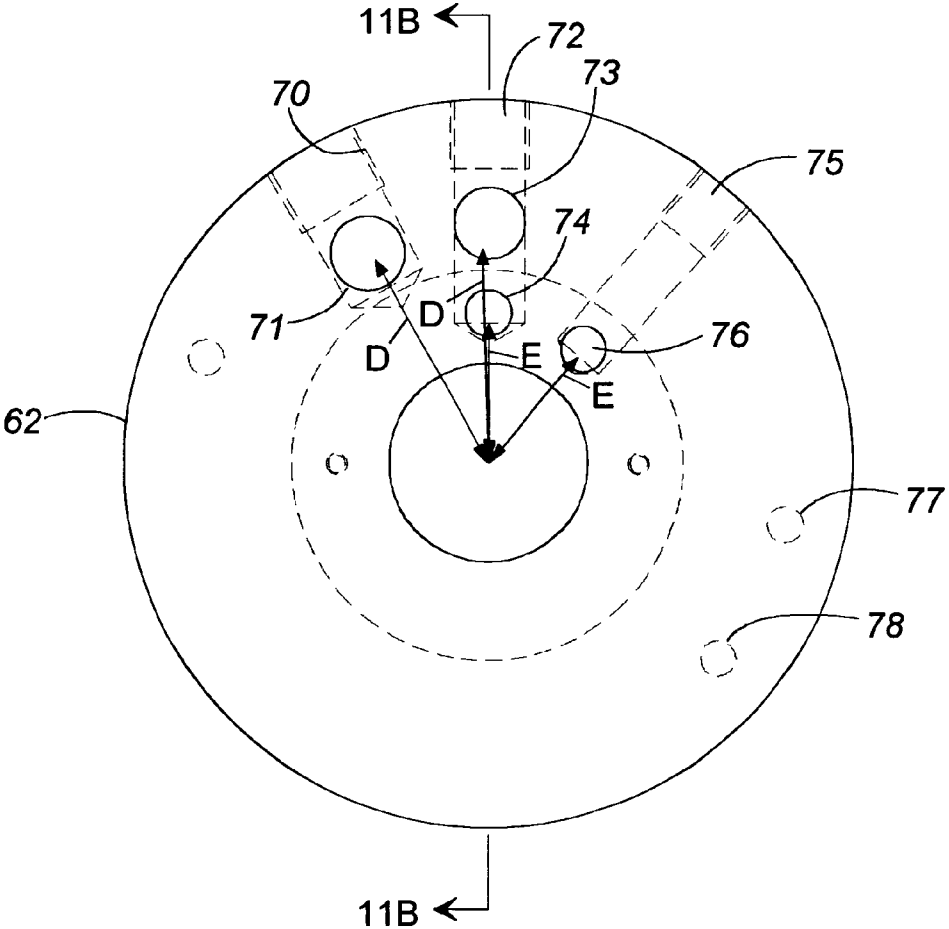
FIG. 11A is a front plan view of a base plate of a valve assembly in connection with the alternative embodiment of the present invention.

Details of the valve plate base arc illustrated in FIGS. 11A and 11B. As is seen in FIGS. 11A and 11B, the valve base 102 includes a vacuum inlet 111 connected to a vacuum source (not shown) which terminates at a first distance D from a center portion of the valve assembly. A vacuum inlet port 112 extends between the terminus of the vacuum inlet 111 and the bearing surface 113 of the base plate. The valve base plate also includes a compressed air inlet 114 which terminates at a distance E from a center portion of the assembly. The base plate also includes a compressed air inlet port 115 extending between the bearing surface 113 and terminal end of the compressed air inlet. Finally, the base plate 102 includes a compression/vacuum outlet 116 which terminates at the distance E from the center portion of the valve assembly. The compression/vacuum outlet includes a compressed air outlet port 117 disposed at a distance E from a center portion of the valve assembly and a vacuum outlet port 118 disposed at distance D from the center portion of the valve assembly.

Figure 10B:
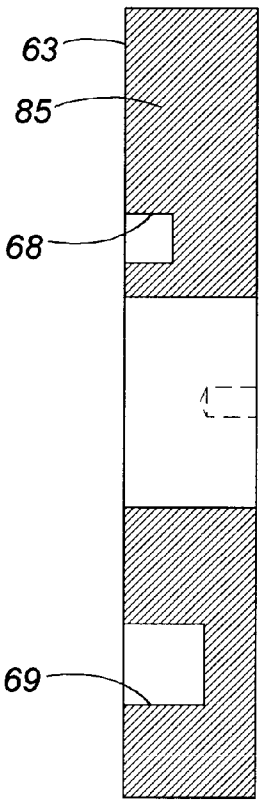
FIG. 10B is a cross-sectional view taken along line 10B—10B of FIG. 10A.
Figure 10A:
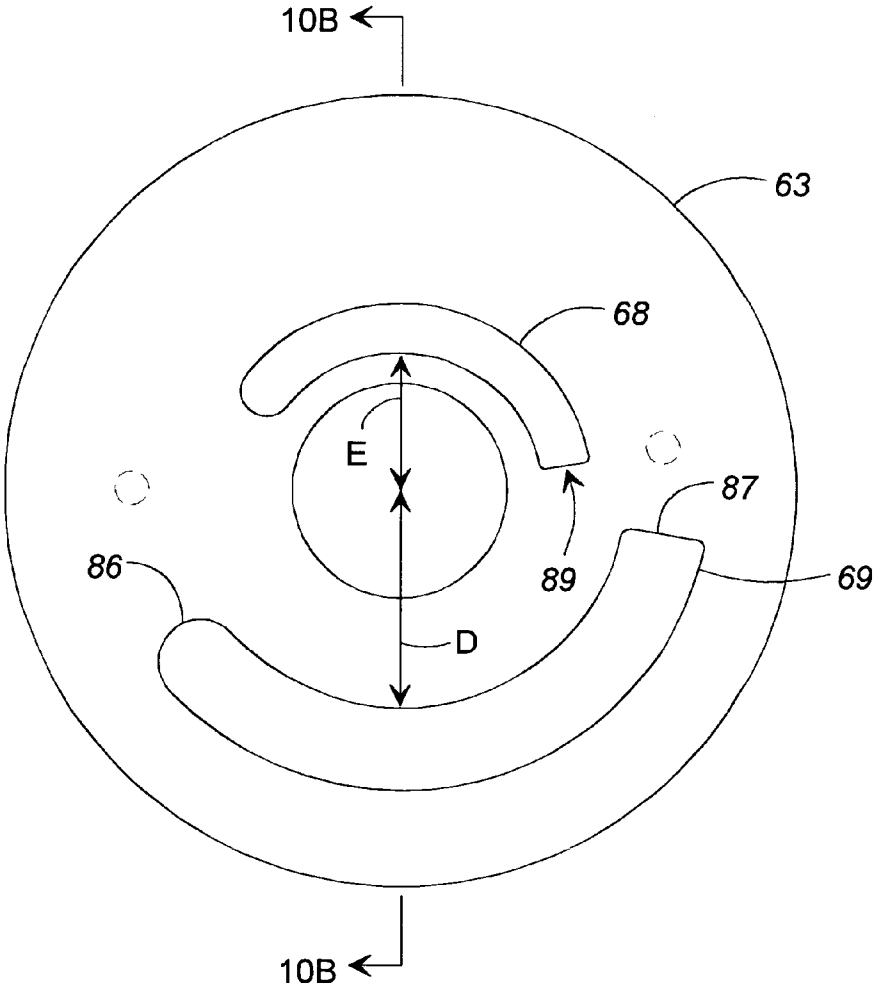
FIG. 10A is a front plan view of a rotating port plate of a valve assembly in connection with the alternative embodiment of the present invention.

Referring now to FIGS. 10A and 10B, the rotating valve plate 103 includes an arcuate compressed air supply port 119 disposed at the distance E from a center portion of the valve assembly and an arcuate vacuum air supply port 120 disposed at a distance D from the center portion of the valve assembly.

In operation of the valve, the bearing surfaces 121 and 113 engage one another. The rotating port plate 103 rotates with respect to the base plate to provide a vacuum and then compression to the vacuum cups for every revolution of the valve. More specifically, the leading edge 122 intersects with vacuum inlet port 112 and vacuum outlet port 118 to provide a fluid communication therebetween, thus allowing a vacuum to be applied to a vacuum cup via the compression/vacuum outlet 116. Upon further rotation, a trailing edge 123 of the rotating port plate 103 intersects the space between vacuum inlet port 112 and vacuum outlet port 118 on bearing surface 113 of adjustable vacuum valve base plate 103 to complete the vacuum phase. Next, the leading edge 124 of the arcuate compressed air supply port 119 then intersects the compressed air outlet port 117 and compressed air inlet port 115 to provide fluid communication therebetween, thereby allowing compressed air to flow from compressed air inlet 114, through compressed air inlet port 115, through arcuate port 119, and out through compressed outlet port 117 and compression/vacuum outlet 116 to the vacuum cup to release a carton from the vacuum cup.

Figure 12B:
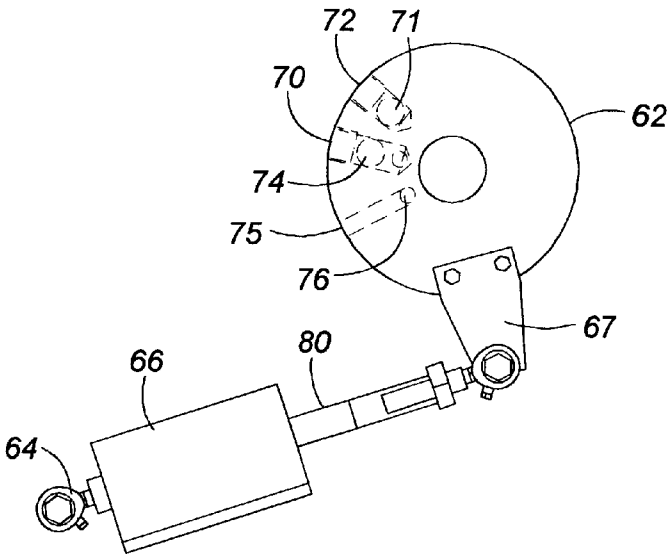
FIGS. 12A through 12C illustrate various positions of the base plate within the valve assembly for advancing timing within the alternative embodiment of the present invention.
Figure 12C:
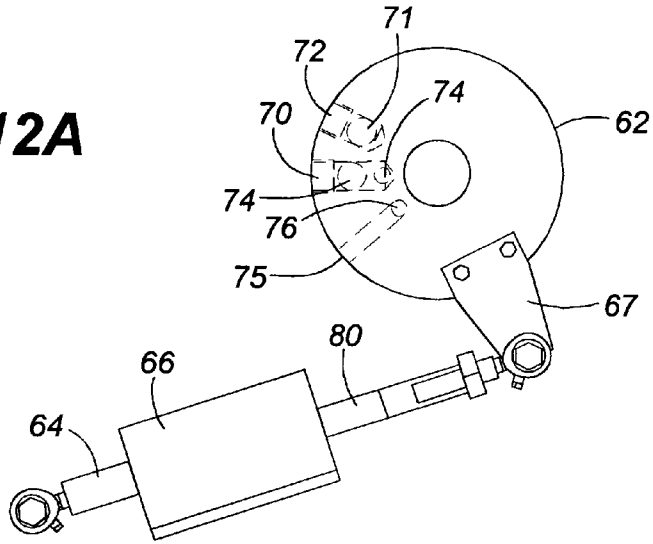
Figure 12A:
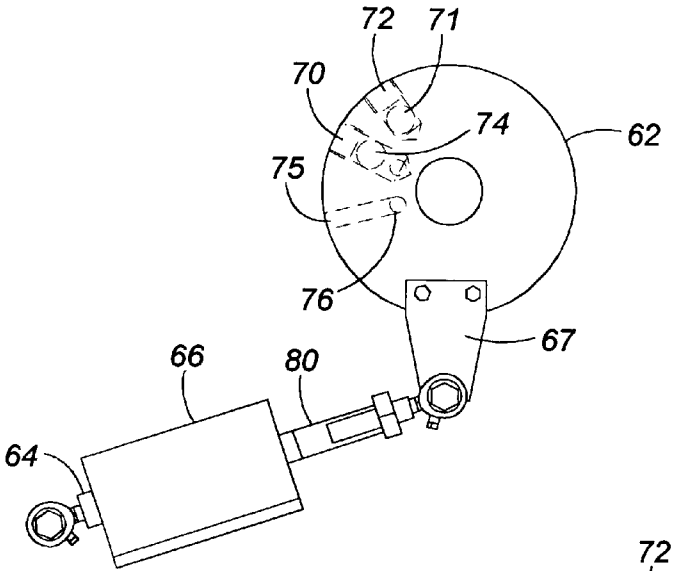

As was described in greater detail above, timing of application of a vacuum to the vacuum cups must be advanced with increasing machine speed. FIGS. 12A, 12B, and 12C indicate the various positions of the pneumatic cylinder assembly with increased machine speed. FIG. 12A illustrates a fully retracted position of the cylinder assembly 65 with cylinders 105 and 106 in a fully retracted position. FIG. 12B illustrates the cylinder assembly 65 in an intermediate position with cylinder 106 extended and cylinder 105 in a retracted position, thereby circumferentially adjusting the base plate 103 opposite the direction of port plate rotation, into a first position. Finally, a third position of the assembly, which advances vacuum/compression time the most, is illustrated in FIG. 12C with both cylinders 105 and 106 in extended positions. FIG. 12A illustrates the base plate circumferential position for the slowest machine speed while FIG. 12C illustrates the base plate circumferential position for the fastest of machine speeds.

While preferred embodiments have been illustrated and described above, it is recognized that variations may be made with respect to features and components of the invention. Therefore, while the invention has been disclosed in preferred forms only, it will be obvious to those skilled in the art that many additions, deletions and modifications can be made therein without departing from the spirit and scope of this invention, and that no undue limits should be imposed thereon except as set forth in the following claims. For example, it is contemplated that the dual valve assembly, mechanical valve and/or the speed compensation components and method could be used in association with divider panel feeders and in conjunction with rotating wheel-type carton feeders. The ordinarily skilled artisan will also understand that any number of actuators may be utilized to actuate the rotation of the valve base plate to advance or retard timing of the application of a vacuum to the vacuum cups. Additionally, the ordinarily skilled artisan will understand that advancing or retarding vacuum/compression timing may require any number or an infinite number of valve positions.

What is claimed is:

1. In an article packaging machine of the type having a carton feeder, an article grouping assembly and an article placement assembly for packaging the articles into the cartons, the carton feeder, comprising:

a carton magazine defining a carton feed path extending from an upstream position to a downstream position and also defining a carton selection zone at the downstream position;

a carton selector assembly positioned adjacent the downstream position of said magazine, said carton selector assembly comprising at least one vacuum/pressure assembly disposed adjacent to said carton selection zone, said vacuum/pressure assembly comprising an arm, a support member supporting said arm and adapted to move said arm toward and away from said selection zone, and a vacuum cup mounted to said arm, said vacuum/pressure assembly further comprising a drive for reciprocating said arm;

a valve assembly for selectively supplying a vacuum and compression to said vacuum cup, said valve assembly comprising a circumferentially adjustable vacuum valve base and a rotating valve port plate disposed adjacent said adjustable vacuum valve base for selectively providing a vacuum to said vacuum cup during the selection and transfer of a carton, and for providing compression to said vacuum cup upon the release of a carton, wherein said adjustable valve base includes a peripheral wall, an inner bearing surface, a vacuum supply inlet extending from said valve base peripheral wall and terminating at a first distance from a center portion said valve assembly, a vacuum inlet port extending from said terminal end of said vacuum supply inlet to said valve base bearing surface, a compression/vacuum outlet extending from said peripheral wall and terminating at a second distance from a center portion of said valve assembly, a vacuum outlet port extending between said compression/vacuum outlet bore and said valve base bearing surface at said first distance, a compressed air outlet port extending from said compression/vacuum outlet bore to said valve base bearing surface at said first distance, a compressed air inlet extending from said peripheral wall and terminating at said second distance, and a compressed air inlet port extending between said compressed air inlet terminus and said valve base bearing surface, said rotating valve port plate further comprising a bearing surface, an arcuate vacuum port having first and second ends and disposed in said port plate bearing surface at said first distance, and an arcuate compressed air port in said port plate bearing surface disposed at said second distance, wherein said valve base and port plate bearing surfaces rotatingly engage on another, and wherein during a single rotation of said port plate, said arcuate vacuum port provides fluid communication between said vacuum inlet port and said vacuum outlet port of said base plate to provide a vacuum through said compression/vacuum outlet to said vacuum cup to engage a carton blank, and said arcuate compression port provides fluid communication between said compressed air inlet port and send compressed air outlet port to provide compressed air to said vacuum cup through said compression/vacuum outlet after vacuum delivery;

a radial adjustment arm extending radially outward from said valve base;

an actuator for providing a circumferential adjustment to said vacuum valve base to adjust vacuum and compression application timing, wherein said actuator rotates said valve base to advance or retard timing of vacuum and compression delivery to said vacuum cup, said actuator including an air cylinder actuator assembly coupled between said machine and said radial adjustment arm, wherein said air cylinder linearly extends or retracts to rotate said radial adjustment arm on said valve base to adjust said valve timing;

a controller responsive to machine speed for controlling said actuator; and a carton engagement assembly positioned adjacent to said vacuum assembly, wherein said vacuum assembly is adapted to remove a carton from said magazine and direct said carton to said carton engagement assembly.

2. The carton feeder of claim 1, wherein said controller further comprises:

a machine speed sensor;

and a solenoid-actuated valve responsive to said controller for supplying air to said air cylinder actuator assembly.

3. The carton feeder of claim 1, wherein said air cylinder actuator assembly comprises:

first and second pneumatic cylinders connected in tandem, wherein each said cylinder has a retracted and an extended position; whereby when said cylinders are connected to form said assembly, said assembly includes a retracted position wherein said first and second cylinders are in a retracted position, a first extended position wherein said first cylinder is extended and said second cylinder is retracted, and a second extended position wherein said first and second cylinders are both in an extended position.

4. The carton feeder of claim 1, wherein said carton magazine includes a conveyor defining a carton feed path for moving said cartons from adjacent said upstream toward said downstream position.

5. The carton feeder of claim 4, and carton meter means disposed adjacent said conveyor for selectively controlling the flow of cartons toward said downstream position.

6. The carton feeder of claim 5, wherein said carton meter means comprises a wheel, said wheel-defining serrations along its circumference.

7. The carton feeder of claim 6, wherein said circumference of said wheel is positioned above said conveyor.

8. The carton feeder of claim 1, said support member comprising a shaft extending substantially perpendicular to said path of travel; and a drive operatively connected to said shaft to rotate said shaft, wherein said arm is rotated along with said shaft to move said vacuum cup toward and away from said selection zone.

9. The carton feeder of claim 5, and a roller disposed adjacent said conveyor at a position above said conveyor so that a carton contacting said metering means will simultaneously contact said roller.

10. The carton feeder of claim 1, wherein said carton engagement assembly comprises a segmented wheel and a drive for said segmented wheel to rotate said segmented wheel.

* * * * *